US005245806A

United States Patent [19]

Baur et al.

[11] Patent Number: 5,245,806

[45] Date of Patent: Sep. 21, 1993

[54] CONCRETE BEAM CONDUIT GUIDE

[75] Inventors: Kenneth C. Baur, Mohnton; Douglas B. Mackley, Stevens, both of Pa.

[73] Assignee: High Industries, Inc., Lancaster, Pa.

[21] Appl. No.: 801,691

[22] Filed: Dec. 2, 1991

[51] Int. Cl.[5] ..... E04B 1/00

[52] U.S. Cl. ..... 52/127.3; 52/577; 52/381

[58] Field of Search ..... 52/127.3, 380, 381, 52/382, 220, 221, 577, 699, 700, 95, 710; 174/48, 49

[56] References Cited

U.S. PATENT DOCUMENTS

| | | | |
|---|---|---|---|
| 2,297,179 | 9/1942 | Walker | 72/16 |
| 3,276,176 | 10/1966 | Jonsson et al. | 52/309 |
| 3,514,070 | 5/1970 | McArdle | 249/207 |
| 3,546,830 | 12/1970 | Villaneau | 52/100 |
| 3,841,206 | 10/1974 | Meckler | 98/40 |
| 3,848,379 | 11/1974 | Hazen | 52/221 |
| 3,871,146 | 3/1975 | Hamy | 52/79 |
| 3,894,368 | 7/1975 | Crofoot | 52/105 |
| 4,211,045 | 7/1980 | Koizumi et al. | 52/251 |
| 4,261,598 | 4/1981 | Cornwall | 285/56 |
| 4,330,969 | 5/1982 | Quaney | 52/81 |
| 4,619,087 | 10/1986 | Harbeke | 52/221 |
| 4,623,170 | 11/1986 | Cornwall | 285/4 |
| 4,624,086 | 11/1986 | MacKay | 52/220 |
| 4,625,940 | 12/1986 | Barton | 52/577 X |
| 4,627,203 | 12/1986 | Presswalla et al. | 52/221 |
| 4,882,886 | 11/1989 | Harbeke | 52/232 |
| 4,934,121 | 6/1990 | Zimmerman | 52/583 |
| 5,035,097 | 7/1991 | Cornwall | 52/220 |

OTHER PUBLICATIONS

Public uses-High Concrete Structures. See Information Disclosure Statement.

*Primary Examiner*—Carl D. Friedman
*Assistant Examiner*—Creighton Smith
*Attorney, Agent, or Firm*—Thomas Hooker

[57] ABSTRACT

A concrete beam conduit guide includes a hollow open ended prismatic body with a downwardly sloping roof, an upward sloping floor, sidewalls and seal flanges at the open ends of the body.

17 Claims, 2 Drawing Sheets

CONCRETE BEAM CONDUIT GUIDE

FIELD OF THE INVENTION

The present invention relates to conduit guides which are cast in concrete beams, commonly T-beams.

BACKGROUND OF THE INVENTION

Conduit passages are commonly formed in cast concrete beams by positioning a knock-out member in the form used to cast the beam, filling the form with concrete, allowing the concrete to harden and then knocking the member out of the resultant beam to form the passage. The members are conventionally made of wood or styrofoam. The openings formed by the members are used for stringing utility conduits through the thickness of the beam.

Problems are encountered using wooden and styrofoam knock-out members. Wooden members absorb water, tend to crack and have a limited useful life. The walls of passages formed using wooden knock-out members are rough and can injure conduits which are pulled through the passages.

The styrofoam knock-out members are easily removed from the concrete beam. Removal of the styrofoam members destructs the styrofoam, forming a large number of relatively small styrofoam beads which tend to stick to the concrete and may become scattered at the removal site. These styrofoam fragments, together with the main body of the member, must be collected and disposed of in an environmentally-safe manner.

SUMMARY OF THE INVENTION

The present improved conduit guide is formed from a unitary hollow plastic body including a roof, a floor and sidewalls with seal flanges extending around both open ends of the body. The flanges engage the form used to cast the concrete beam to both hold the guide in place during casting and prevent the liquid concrete from flowing into the hollow interior of the guide. The guide is prismatic in shape with a pair of flat top panels extending downwardly from the peak of the roof and a pair of flat bottom panels extending upwardly from the valley bottom of the floor. The flat, vertical sidewalls join the top and bottom panels to form a strong body about which the relatively thick and heavy concrete may be poured without deformation The gabled top of the body flows the concrete to both sides of the body during pouring.

The disclosed conduit guide is adapted to be cast into T-beams of the type commonly used to construct multi-floor parking garages. These beams include a long flat top panel with a pair of dependent legs extending downwardly from the top panel. The guides are cast into the T-beams at the top of the legs adjacent the bottom of the flat panel to facilitate feeding of conduit lines through the guides flush against the bottom of the top panel. The guides fit into the mold at the curved top of the legs with the tops of the panels having a greater longitudinal length than the bottoms of the panels and the ends of the sidewalls being curved to conform with the increasing width of the mold at the top of the legs. The circumferential flange extends completely around the ends of the guides to retain the guide in place and prevent the concrete from flowing into the interior of the guide.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figures 1, 2, 3, 4:
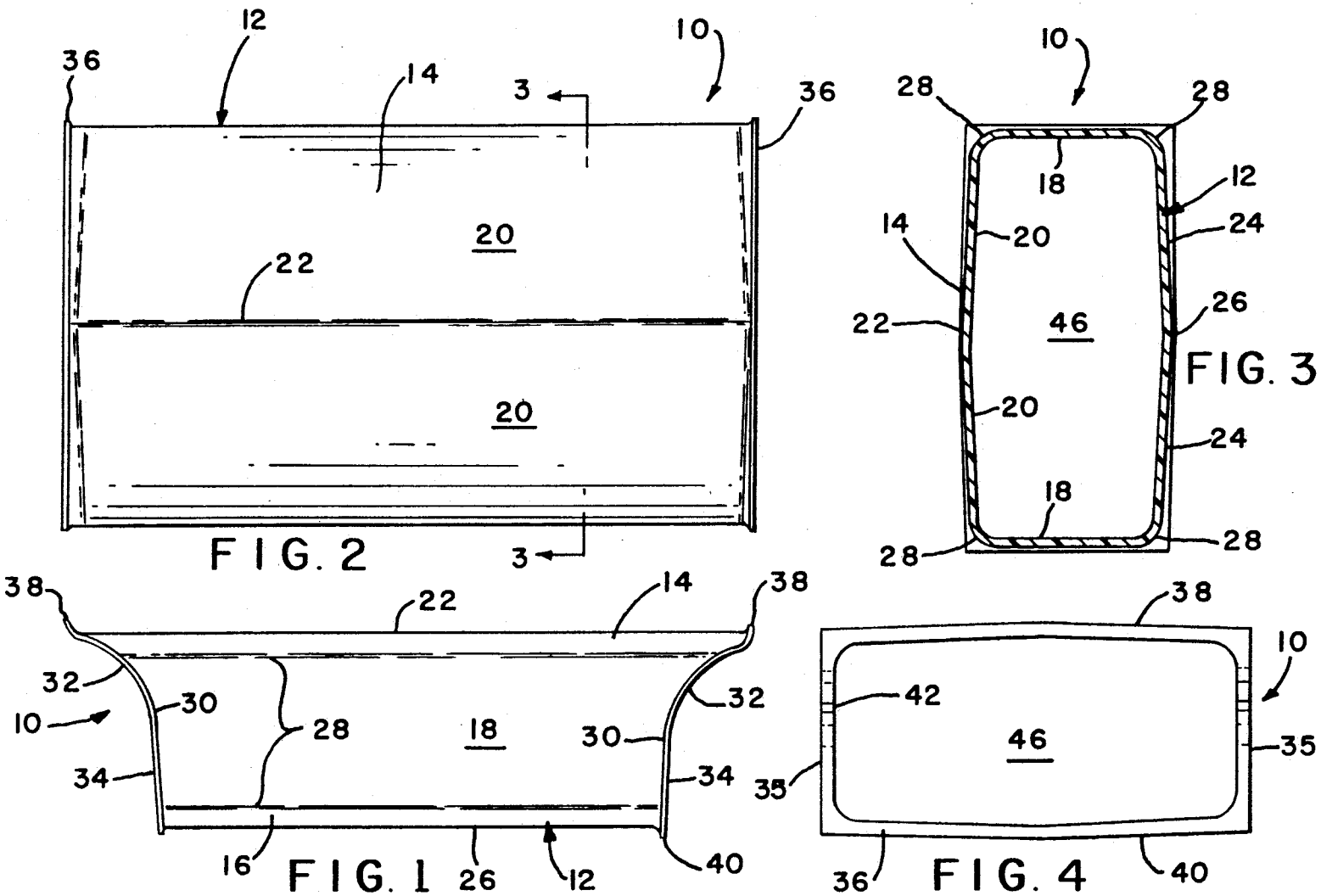
FIG. 1 is a side view of conduit guide according to the invention.
FIG. 2 is a top view of FIG. 1.
FIG. 3 is a transverse sectional view taken along line 3—3 of FIG. 2.
FIG. 4 is an end view of the guide.

Conduit guide 10 includes an integral molded plastic body 12 having a roof 14, floor 16 and vertical sidewalls 18 extending between the roof and floor. The roof includes two flat gabled roof panels 20 joining at peak 22 and extending the length of the guide. The panels extend downwardly to either side of the peak at a shallow angle as shown in FIG. 3. The floor includes a pair of floor panels 24, similar to roof panels 20, which slope downwardly from the sidewalls 18 to valley bottom 26 located beneath the peak 22. As shown in FIG. 1, the roof extends longitudinally beyond the ends of the floor. The sidewalls join the roof and floor at rounded corners 28.

The ends 30 of sidewalls 18 are concave as shown in FIG. 1 and include an upper inwardly curved portion 32 and a straight, nearly vertical lower portion 34. A continuous circumferential flange 36 extends completely around the top, sidewalls and floor of the guide and projects radially outwardly from the guide. The portions 35 of the flange extending from the sidewalls 18 are perpendicular to the sidewalls while the portions 36 and 40 of the flange at the roof and floor portion 40 extend generally outwardly and away from the end of the guide provides a resilient seal at the bottom of the guide. The flange 40 engages the concrete form used to cast the panel and aids in holding the guide in place in the form during pouring of concrete. Flanges 35 rest flush on the form.

The roof, floor, sidewalls and flanges of guide 10 define a smooth interior surface 42 on the interior of the guide with smooth, rounded corners 44 at the ends of the guide. These surfaces and corners facilitate feeding of power conduits, water lines, and the like through the interior passage 46 extending the length of the guide.

Figure 5:
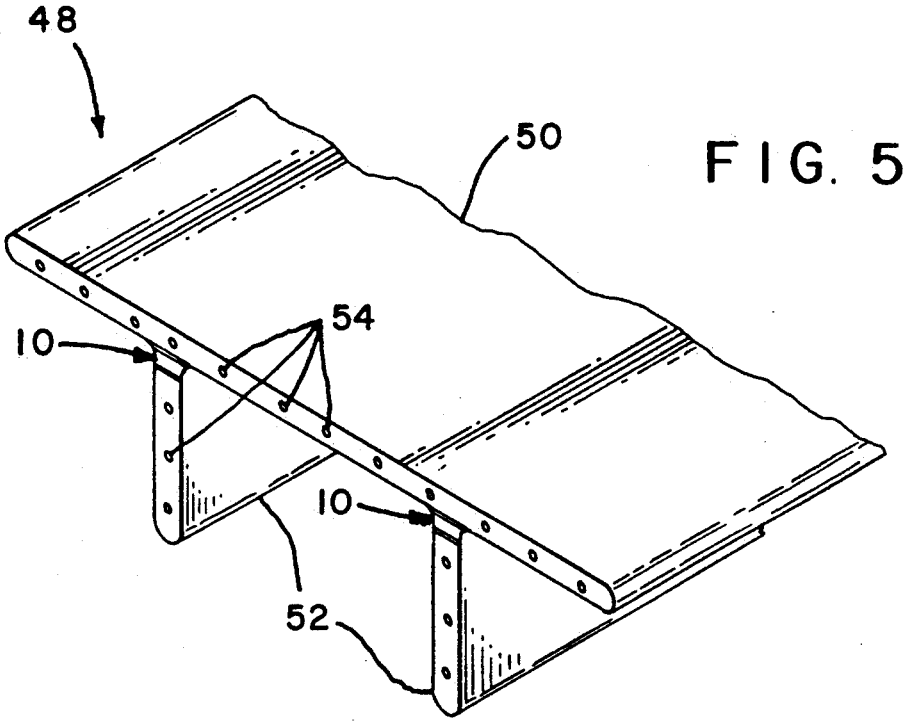
FIG. 5 is a perspective view of a cast concrete T-beam having two legs with conduit guides molded in place on the upper ends of the legs.

FIG. 5 illustrates a cast concrete T-beam 48 having an essentially flat supporting top panel 50 and a pair of dependent legs 52 extending downwardly from the panel. Reinforcing tension cables 54 may be embedded in the beam as shown.

Figure 6:
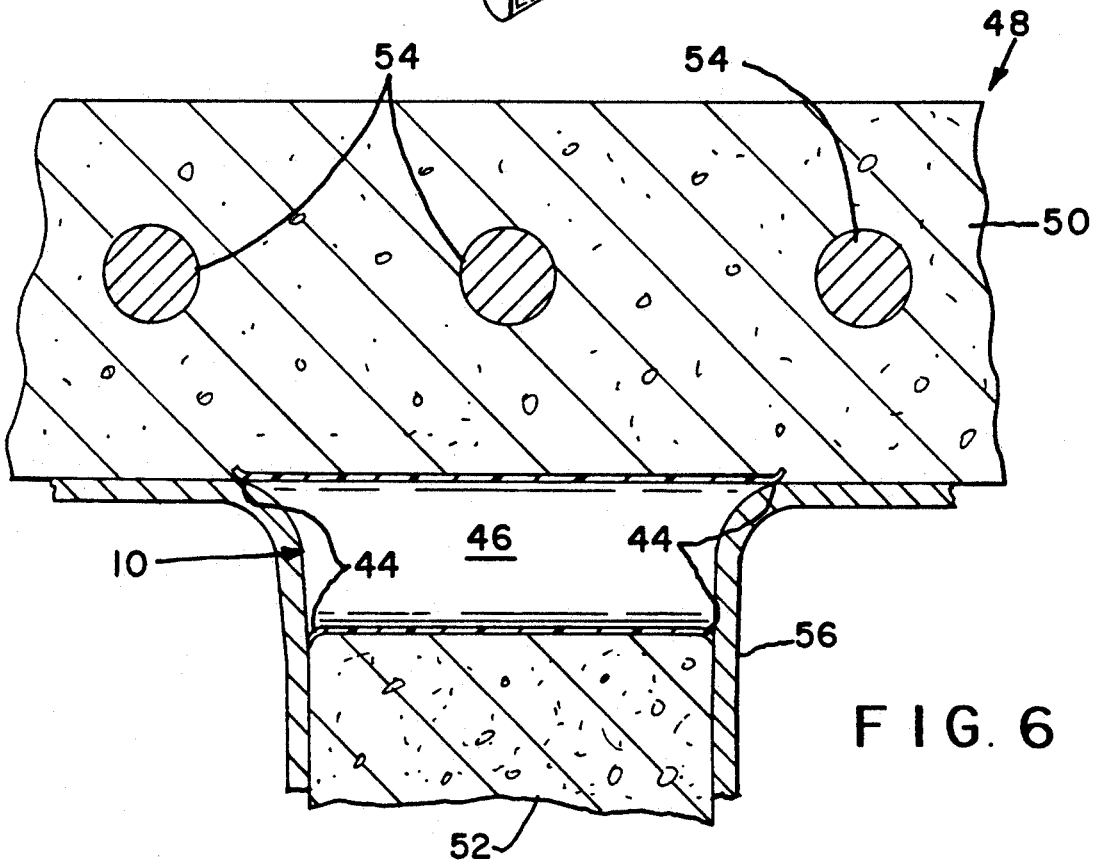
FIG. 6 is an enlarged view showing the mold used to cast the beam of FIG. 5 with a conduit guide in place.

Beams 48 are cast using a mold or form defining the shape of the legs and the lower surface and sidewalls of the top panel. FIG. 6 illustrates the portion of the form 56 at the top of one leg 52 or the knee junction with the top panel. Cables 54 are rigged and guides 10 are positioned in the knee portions of the form at intervals along the length of the legs where openings will be required in the completed beam for utility wires, conduits, water lines, and the like.

The guides are placed in the empty forms as shown in FIG. 6. The flanges 36 touch against the interior surfaces of the form to create an effective seal between the guide and form to prevent concrete from flowing into the guide. The top flange 38 may be spaced a slight distance above the form. However, the concrete is too viscous to flow through the small opening. The lower seal lips 40 are compressed against the form and retain the guide in place in the form. As illustrated, the ends 30 of the side-walls 18 conform to the adjacent curved and straight portions of the form to provide an effective seal. Portions 35 rest flush on the form.

With the cables 54 and guides 10 in place, the form 56 is filled with liquid concrete up to the level of the top of panel 15. Heavy liquid cement flows over the guides 10 and down into the mold cavities forming legs 52. The prismatic shape of the guides formed by panels 20, sidewalls 18 and panels 24 strengthen the guides to prevent collapse or deformation during pouring. The guides tend to be wedged firmly against the form. Additionally, the downwardly sloping roof panels 20 flow cement to either side of the guides and down into the leg cavity. The guides 10 are spaced sufficiently apart along the leg 52 to assure that the gravity-flowed cement completely surrounds the guides to form a strong void-free beam.

After pouring, the concrete in the form is allowed to cure following which the form is stripped away from the beam. Guides 10 ar retained in place at the top of the legs 52 immediately under the lower surface of panel 15. After the concrete is completely cured and is set as part of a structure, commonly, a parking garage, conduits and wires are easily extended through the guides and neatly fastened to the undersurface of the top panel 50. In this way, the utilities are located out of the way and do not obstruct space between the dependent legs 52. The smooth interior sides of the guide 42 and end corners 44 assure that the elongate utility wires, conduits and the like may be easily threaded and pulled through the conduit guides without abrasion or injury by engaging rough concrete surfaces. As shown in FIG. 5, a pair of guides 10 may be located in the upper portions of adjacent legs 52 across from each other in order to facilitate stringing of a single conduit through both legs 52.

Guide 10 is preferably formed from a resilient plastic material such as polyvinyl chloride (PVC) using a blow molding process. The end portions of the blow molded body are trimmed away at flanges 36.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A concrete beam conduit guide comprising a hollow elongate body having opposed open ends including a gabled roof having a central top peak and a pair of top panels extending downwardly and outwardly from the top peak, a sloped floor having a central bottom valley and a pair of bottom panels extending upwardly and outwardly from the bottom valley, a pair of sidewalls connecting the top and bottom panels, said top, floor and sidewalls defining an interior conduit passage, and seal means at both open ends of the body for engaging a form used to cast a concrete beam around the guide and preventing the liquid concrete from flowing into the interior conduit passage.

2. A guide as in claim 1 wherein the longitudinal length of the roof is greater than the longitudinal length of the floor.

3. A guide as in claim 1 wherein said panels and sidewalls are essentially flat.

4. A guide as in claim 1 wherein said body is integrally formed from a plastic material.

5. A guide as in claim 1 wherein said seal means comprises flanges extending around the circumference of each end of the body.

6. A guide as in claim 5 wherein each of said flanges includes a resilient portion engagable with a form.

7. A guide as in claim 6 wherein the ends of the sidewalls are concave and the guide is adapted to be fitted into a form at a knee juncture between the portion of the form used to cast a dependent leg and a portion of the form defining the bottom of a flat panel perpendicular to the leg.

8. A guide as in claim 7 wherein each end of each sidewall includes a straight portion and an arcuate portion above the straight portion.

9. A guide as in claim 1 wherein the interior surface of the passage is smooth and including rounded corners at the ends of the passage.

10. A concrete beam conduit guide comprising a hollow elongate body having opposed open ends and including:

i. a roof having a top extending longitudinally along the length of the body and upper side portions extending downwardly to either side of the top, ii. a floor having a bottom extending longitudinally along the length of the body and floor side portions extending upwardly from the bottom and joining the upper side portions to define an interior conduit passage extending along the length of the body, the longitudinal length of the roof of the body being greater than the longitudinal length of the floor of the body, and iii. concrete form seal means at each end of the body for engaging an adjacent form to retain the body in place during filling of the form with liquid concrete and prevent liquid concrete from flowing into the interior conduit passage.

11. A guide as in claim 10 wherein said seal means comprises a circumferential flange extending completely around the body at each end of the body.

12. A guide as in claim 11 wherein each flange includes a resilient portion engagable with a form to retain the guide in position, during concrete pouring.

13. A guide as in claim 12 wherein the resilient portion is located adjacent the floor.

14. A guide as in claim 11 wherein the interior surface of the conduit passage is smooth and including rounded corners at the ends of the passage.

15. A guide as in claim 10 wherein the ends of the body between the top and the bottom are concave.

16. A concrete beam conduit guide comprising a hollow elongate body having opposed open ends and including:

i. a roof having a top extending longitudinally along the length of the body and upper side portions extending downwardly to either side of the top, ii. a floor having a bottom extending longitudinally along the length of the body and floor side portions extending upwardly from the bottom and joining the upper side portions to define an interior conduit passage extending along the length of the body, and iii. a concrete form seal at each end of the body for engaging an adjacent form to retain the body in place during filling of the form with liquid concrete and prevent liquid concrete from flowing into the interior conduit passage, each seal being a resilient and integral portion of the body.

17. A guide as in claim 16 wherein said body is formed from an integral molded piece of plastic.

* * * * *